US009919176B2

(12) United States Patent
Christie et al.

(10) Patent No.: US 9,919,176 B2
(45) Date of Patent: Mar. 20, 2018

(54) EXERCISE RESISTANCE DEVICE

(71) Applicant: REBAR LLC, Redmond, WA (US)

(72) Inventors: Douglas D. Christie, Sherman Oaks, CA (US); Sylvester J. Walters, Mississauga (CA); Timothy Ray Manson, Redmond, WA (US)

(73) Assignee: REBAR LLC, Redmond, WA (US)

( * ) Notice: Subject to any disclaimer, the term of this patent is extended or adjusted under 35 U.S.C. 154(b) by 0 days.

(21) Appl. No.: 14/795,132

(22) Filed: Jul. 9, 2015

(65) Prior Publication Data

US 2016/0038781 A1 Feb. 11, 2016

Related U.S. Application Data

(60) Provisional application No. 62/033,791, filed on Aug. 6, 2014.

(51) Int. Cl.

| | |
|---|---|
| ***A63B 21/02*** | (2006.01) |
| ***A63B 21/00*** | (2006.01) |
| ***A63B 21/04*** | (2006.01) |
| ***A63B 21/055*** | (2006.01) |
| ***A63B 23/035*** | (2006.01) |
| *A63B 21/16* | (2006.01) |
| *A63B 71/02* | (2006.01) |

(52) U.S. Cl.

CPC .... *A63B 21/00061* (2013.01); *A63B 21/0442* (2013.01); *A63B 21/0552* (2013.01); *A63B 21/0557* (2013.01); *A63B 21/4035* (2015.10); *A63B 21/4043* (2015.10); *A63B 23/03525* (2013.01); *A63B 21/00065* (2013.01); *A63B 21/169* (2015.10); *A63B 2071/026* (2013.01); *A63B 2209/02* (2013.01)

(58) Field of Classification Search

CPC ..... A63B 21/00061; A63B 21/0407; A63B 21/0414; A63B 21/055; A63B 21/4035; A63B 21/4043; A63B 23/02; A63B 23/12

See application file for complete search history.

(56) References Cited

U.S. PATENT DOCUMENTS 3,256,015 A * 6/1966 Perrin ..... A63B 21/04 24/129 C
4,059,265 A * 11/1977 Wieder ..... A63B 21/04 482/125

(Continued)

*Primary Examiner* — Joshua Lee
(74) *Attorney, Agent, or Firm* — Innovation Capital Law Group, LLP; Vic Lin

(57) ABSTRACT

An exercise resistance device comprises a first hollow elongated bar and a second hollow elongated bar that can be combined together. The first hollow elongated bar further comprises a first loop on one end and a male connector on the other end, and the second hollow elongated bar further comprises a second loop on one end and a female connector on the other end. The first elongated bar is connected to the second elongated bar by inserting its male connector end into the female connector end of the second elongated bar. A locking mechanism may be provided to secure the connection of the two bars. An interchangeable resistive band is connected to the first loop and the second loop. A user may perform various exercises by pushing the combined first elongated bar and second elongated bar away from the resistive band, and adjusting the tension of the resistive band.

12 Claims, 10 Drawing Sheets

(56) References Cited

U.S. PATENT DOCUMENTS 5,112,287 A * 5/1992 Brewer ..... A63B 21/04 482/123
5,190,512 A * 3/1993 Curran ..... A63B 21/0004 482/122
5,549,532 A * 8/1996 Kropp ..... A63B 21/0552 482/122
6,402,668 B1 * 6/2002 Harker ..... A63B 21/0004 482/121
6,648,804 B2 * 11/2003 Chen ..... A63B 21/0004 482/125
7,090,627 B1 * 8/2006 Walker ..... A63B 21/055 482/121
7,465,259 B2 * 12/2008 Mok ..... A63B 21/0004 482/121
7,922,634 B1 * 4/2011 Wu ..... A63B 21/0004 482/121
9,254,405 B1 * 2/2016 Marji ..... A63B 21/02
2004/0029689 A1 * 2/2004 Contreras ..... A61H 1/0244 482/148
2005/0113223 A1 * 5/2005 Dovner ..... A63B 21/0004 482/121
2005/0239617 A1 * 10/2005 Tenaglia ..... A63B 21/00043 482/122
2006/0052223 A1 * 3/2006 Terry ..... A63B 21/0004 482/126
2008/0096737 A1 * 4/2008 Ayoub ..... A63B 21/0724 482/107
2009/0239675 A1 * 9/2009 Wallace ..... A63B 21/0552 473/220
2010/0152002 A1 * 6/2010 Knight ..... A63B 21/072 482/93
2010/0173760 A1 * 7/2010 Hall ..... A63B 21/0552 482/129
2011/0028288 A1 * 2/2011 Anderson ..... A63B 21/0004 482/124
2014/0349821 A1 * 11/2014 Davis ..... A63B 21/0552 482/122

* cited by examiner

EXERCISE RESISTANCE DEVICE

RELATED APPLICATION

This application relates to, claims priority from and incorporates by reference herein, as if fully sets forth in the U.S. provisional patent application Ser. No. 62/033,791 filed on Aug. 6, 2014 entitled "ReBAR by TERNION."

BACKGROUND OF THE INVENTION

1. Field of the Invention

This invention generally relates to an exercise resistance device.

2. Description of Prior Art and Related Information

The human body consists of two types of muscles: moving muscles and stabilizing muscles. The moving muscles are primarily responsible for producing a movement, while the stabilizing muscles are primarily responsible for providing support and control to the joints and the trunk during the movement. The moving muscles are often considered the large or primary muscle groups, whereas the stabilizing muscles are often considered the small or intrinsic muscle groups. Although the moving muscles are the most prominent muscles in the human body, weak stabilizing muscles will often cause injury and pain in the spine or joints. Therefore, balanced stabilization training is necessary to maximize the strength, mobility and flexibility of the intrinsic muscles to help prevent injury. Known stabilization training methods involve stabilization training of the "core muscles." These core muscles have been traditionally thought of as the muscles supporting the pelvic, lumbar and hip areas. However, it is now generally agreed in the athletic training community that the core muscles include all the musculature that stabilizes the myriad of joints within the human kinetic neuromuscular and skeletal chain.

The exercise devices for core training known in the art typically involve resistance devices that comprise a short, rigid bar made of metal such as steel, connected to one level of resistance band that is not interchangeable. Thus, the non-interchangeable single band feature of the traditional bars severely limit the range of exercise and applicability of the equipment, as well as increase the cost by requiring the user to purchase a separate device every time the user wishes to increase or decrease the level of resistance or vary the exercises. Moreover, the main problem with the traditional resistance devices is that the short length and the rigidity of the bars do not feel natural to the user and may cause over compensation and overreaching of the muscles that lead to injuries.

BRIEF SUMMARY OF THE INVENTION

A current exercise resistance device, or simply a resistance device, that embodies the invention described herein provides an elongated resistance device that is sturdy, yet sufficiently flexible, and includes interchangeable resistive bands having various tensions that can be connected to it. The combination of a flexible yet sturdy device with the interchangeable resistive bands provides for an exercise device that feels natural to the user, and allows for a safe and efficient way to promote a full spectrum of proper neuromuscular movements during core training.

In one aspect, the resistance device comprises a first hollow elongated bar and a second hollow elongated bar, wherein the first hollow elongated bar further comprises a first loop on one end and a male connector on the other end, and the second hollow elongated bar further comprises a second loop on one end and a female connector on the other end. The first elongated bar and the second elongated bar may be tubular. The first elongated bar is connected to the second elongated bar by inserting its male connector end into the female connector end of the second elongated bar. In one embodiment, the first elongated bar further comprises a locking mechanism that fits into a locking mechanism pinhole in the second elongated bar to secure the connection of the two bars. This configuration allows for easy attachment and detachment of the first elongated bar and the second elongated bar. Preferably, the first elongated bar and the second elongated bar are made of carbon fiber material, and the locking mechanism comprises a spring lock.

In one embodiment, each of the first elongated bar and the second elongated bar may be 3 feet in length by 2 inches in diameter. Accordingly, in this particular embodiment, when the resistance device is fully assembled, it may span 6 feet in total length. In one embodiment, a single resistive band is connected to the first loop on one end and the second loop on the other end. In another embodiment, two resistive bands are provided, in which a first resistive band is connected to the first loop and a second resistive band is connected to the second loop.

In a particular embodiment, the resistive bands may include rubber or any suitable elastomers having various resistive tensions. The first loop and the second loop of the resistance device allow the user to easily change the appropriate resistive band according to the user's height, size, strength and desired type of dynamic and static rotary exercises. Thus, the resistance device according to the embodiment of the invention can be used for a wide range of exercises and purposes, such as rehabilitation, customized strengthening/conditioning and injury prevention programs.

Figure 1:
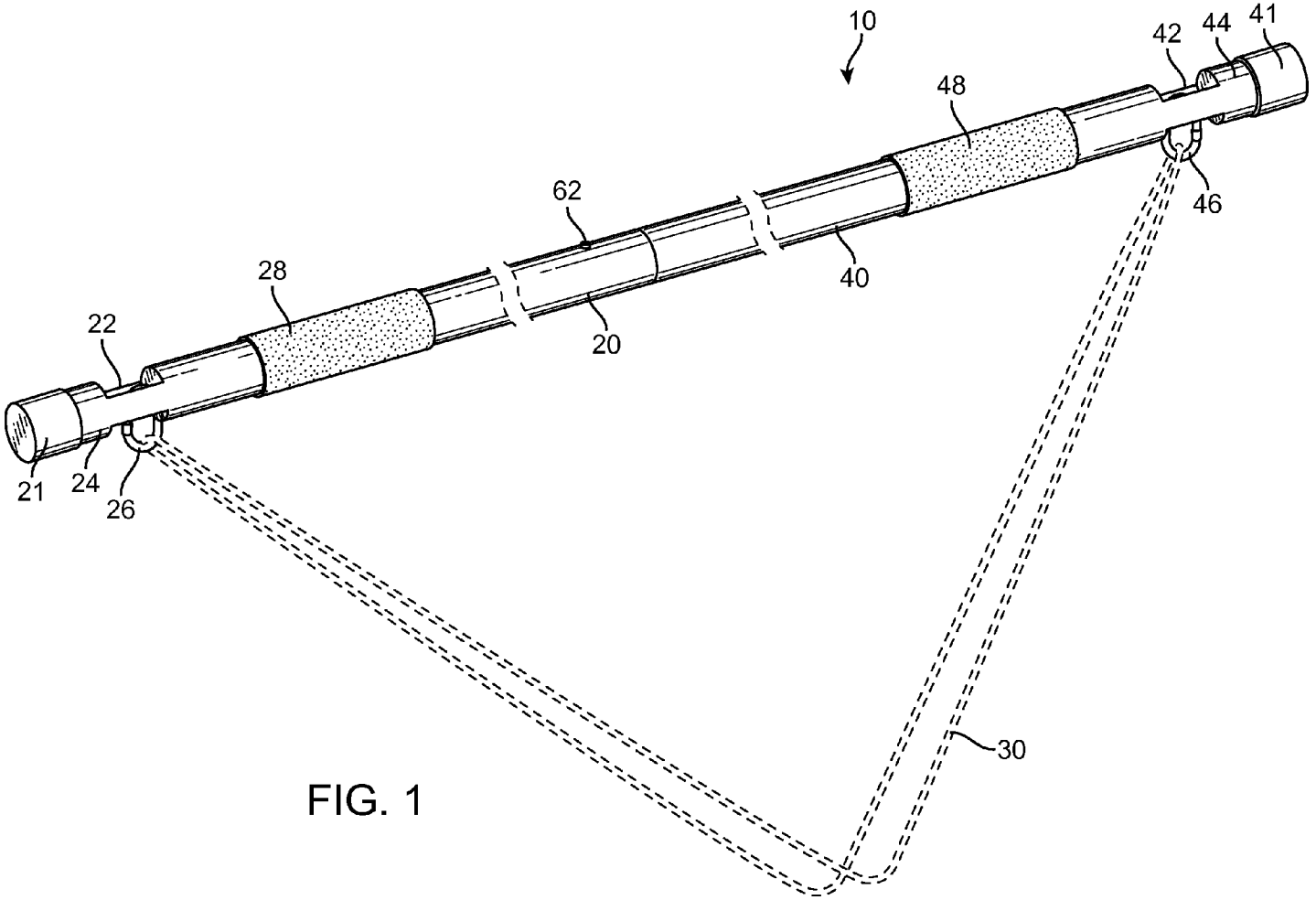
FIG. 1 is a front perspective view of a first preferred embodiment of an exercise resistance device in a fully assembled form.
Figure 2:
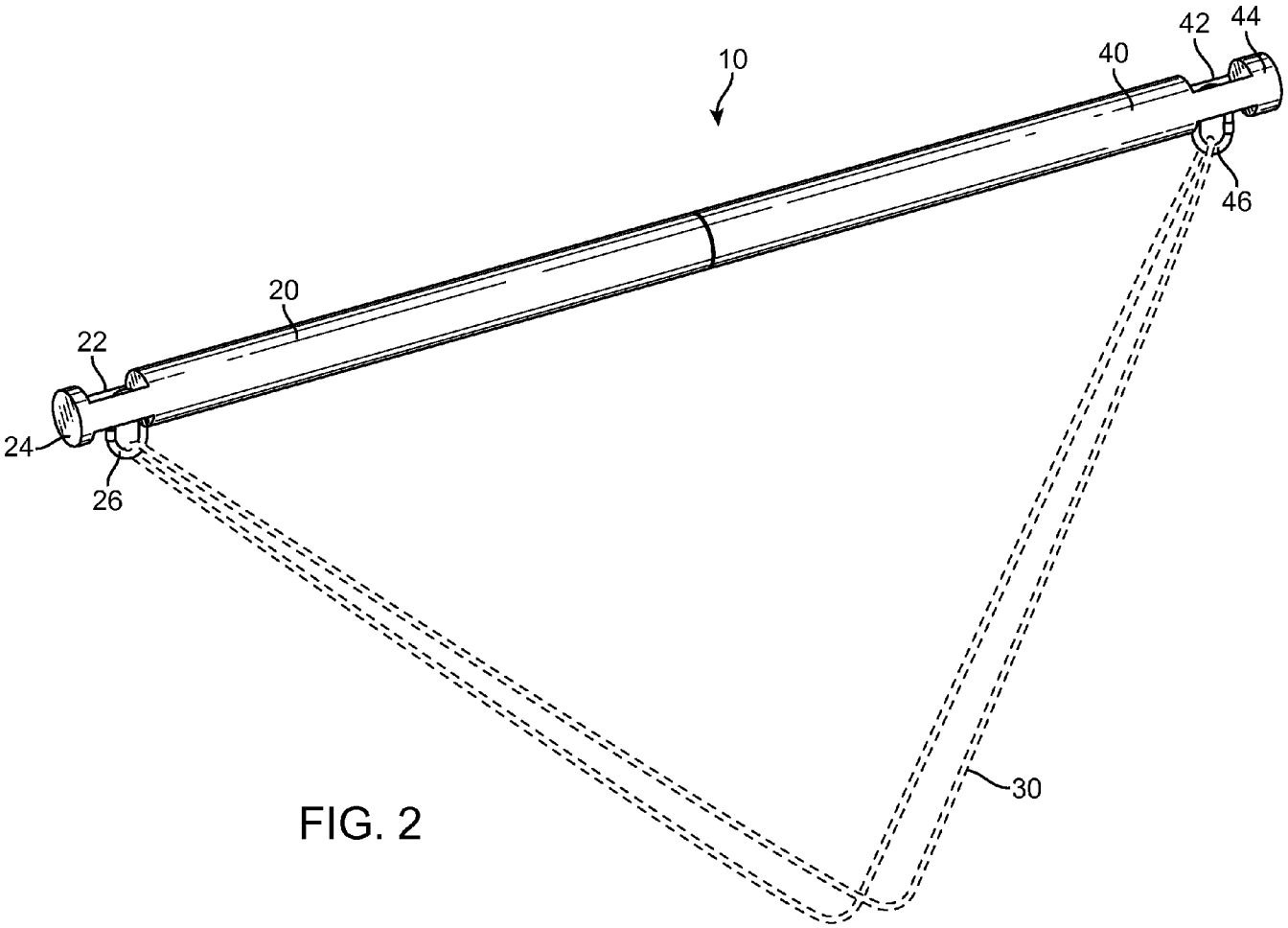
FIG. 2 is a front perspective view of the exercise resistance bar without a pair of hand grips.
Figure 3:
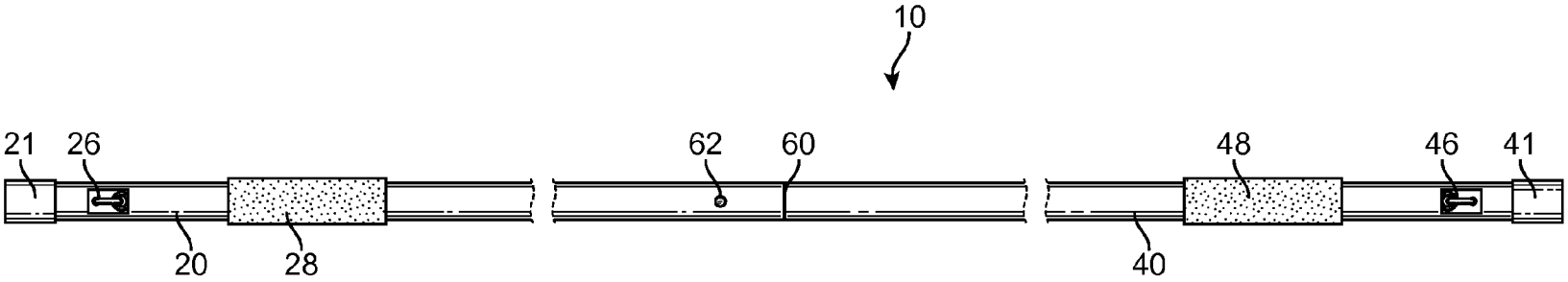
FIG. 3 is a top view of the exercise resistance device.
Figure 4:
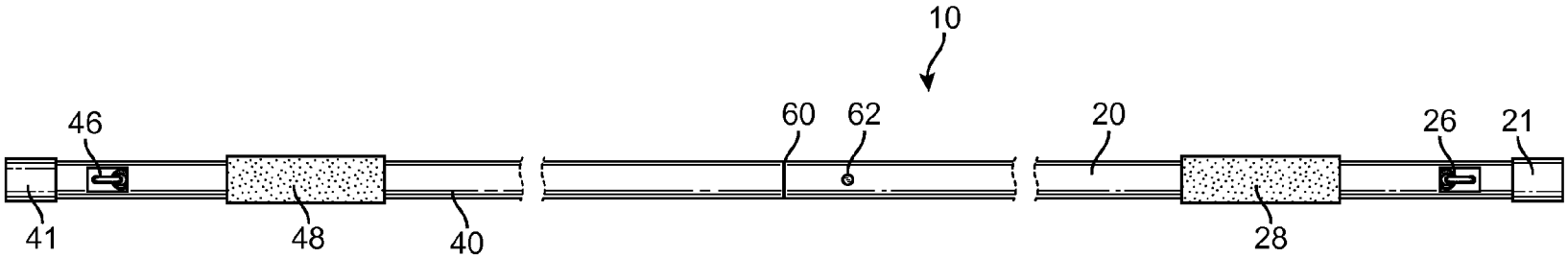
FIG. 4 is a bottom view of the exercise resistance device.
Figure 5:
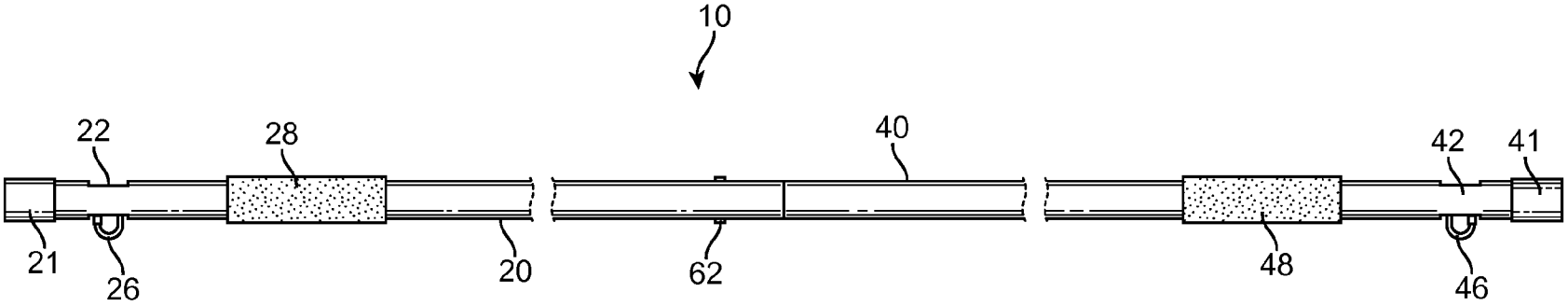
FIG. 5 is a front view of the exercise resistance device.
Figure 6:
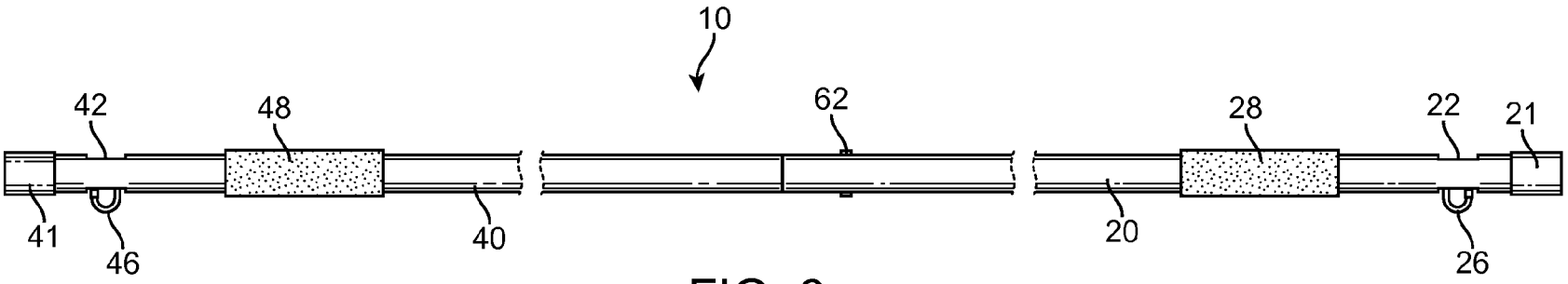
FIG. 6 is a back view of the exercise resistance device.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS

Throughout the specification, positional and directional terms below refer to the following:

"Front" shall refer to the side or direction where a first hollow elongated bar comprising a locking mechanism is positioned on the left hand side of the assembly, and a pair of loops connected to the exercise resistance bar is pointing down.

"Back" shall refer to the side or direction where the first hollow elongated bar comprising the locking mechanism is positioned on the right hand side of the assembly, and the pair of loops connected to the exercise resistance bar is pointing down.

"Bottom" shall refer to the side or direction where the pair of loops connected to the exercise resistance bar is located.

FIGS. 1-6 illustrate a general overview of a first preferred embodiment of an exercise resistance device, or simply a resistance device, in its fully assembled form as designated by a reference numeral 10. The resistance device 10 generally comprises a first hollow elongated bar 20, a second hollow elongated bar 40 and a resistive band 30 connected at a center point 60. In a preferred embodiment, the first elongated bar 20 and the second elongated bar 40 are tubular. The first elongated bar 20 further comprises a first closed end 24, a first loop slot 22 positioned near the first closed end 24, a male connector end 23 (shown in later drawings), a first detachable loop 26 placed in the first loop slot 22 and a locking mechanism 62 positioned on or near the male connector end 23. According to a preferred embodiment, the locking mechanism 62 may comprise a spring lock or a pair of spring locks. The second elongated bar 40 further comprises a second closed end 44, a second loop slot 42 positioned on or near the second closed end 44, a female connector end 43 (shown in later drawings), a second detachable loop 46 placed in the second loop slot 42 and a locking mechanism slot 72 positioned on or near the female connector end 43. The locking mechanism slot 72 may comprise a pinhole or a pair of pinholes or openings that matches the spring lock or the pair of spring locks 62. When the resistance device 10 is fully assembled, the locking mechanism 62 secures the connection between the first hollow elongated bar 20 and the second hollow elongated bar 40.

The first elongated bar 20 may further comprise a first grip 28 and the second elongated bar 40 may further comprise a second grip 48 to provide comfort and traction to a user's hands when the resistance device 10 is in use. In a preferred embodiment, the first grip 28 and the second grip 48 may further comprise high density foam. Further, the first closed end 24 may be covered with a first end cap 21 and the second closed end 44 may be covered with a second end cap 41 to provide safety and additional support for perpendicular ground exercises. In one embodiment, the first end cap 21 and the second end cap 41 may comprise rubber.

According to one preferred embodiment, each of the first elongated bar 20 and the second elongated bar 40 may be 3 feet in length by 2 inches in diameter. Thus, when fully assembled, the resistance device 10 may span 6 feet in total length. However, in other embodiments, each of the first elongated bar 20 and the second elongated bar 40 may be longer than 3 feet in length and bigger or smaller than 2 inches in diameter. Further, the first elongated bar 20 and the second elongated bar 40 are preferably made of carbon fiber material, although any suitable materials that provide sturdiness and flexibility such as aluminum may also be used.

Figure 7:
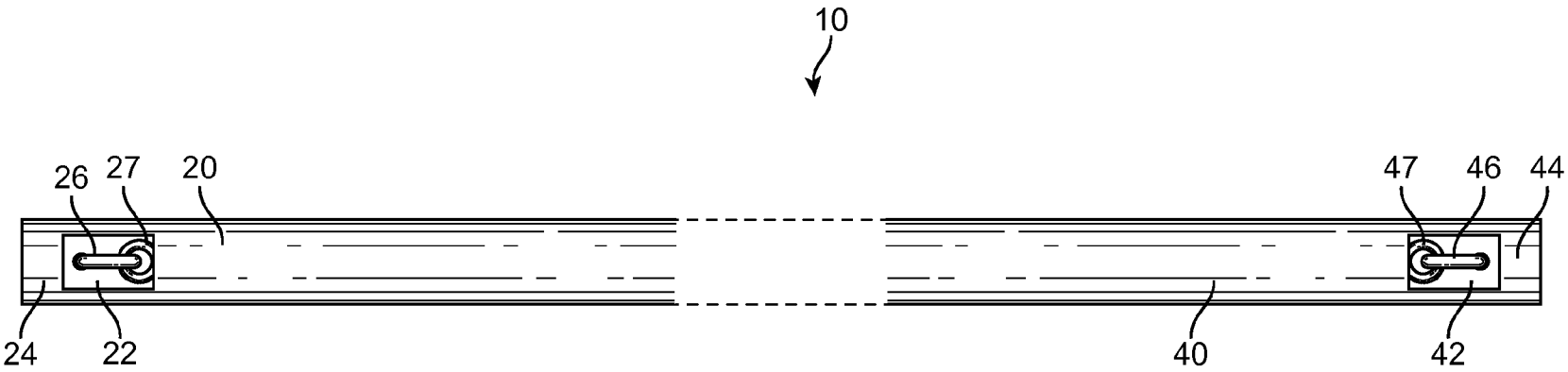
FIG. 7 is a close up, top view of the exercise resistance device.
Figure 8:
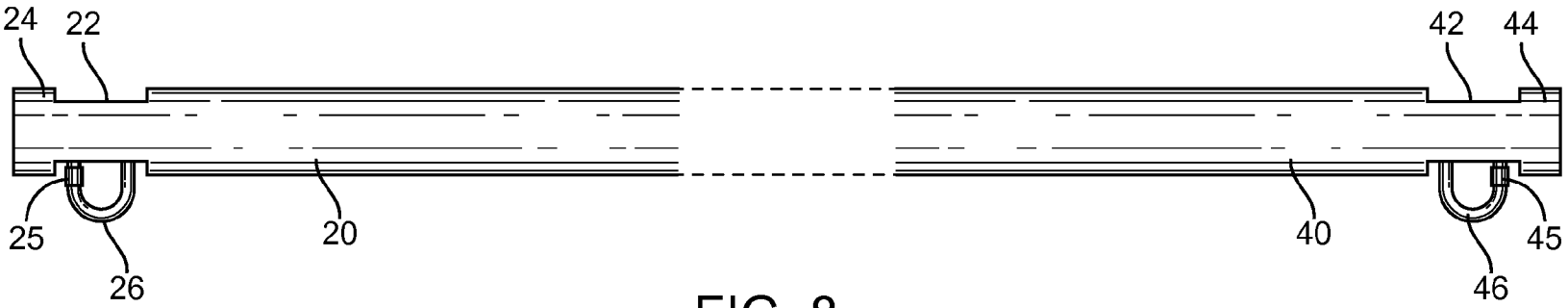
FIG. 8 is a close up, front view of the exercise resistance device.
Figure 9:
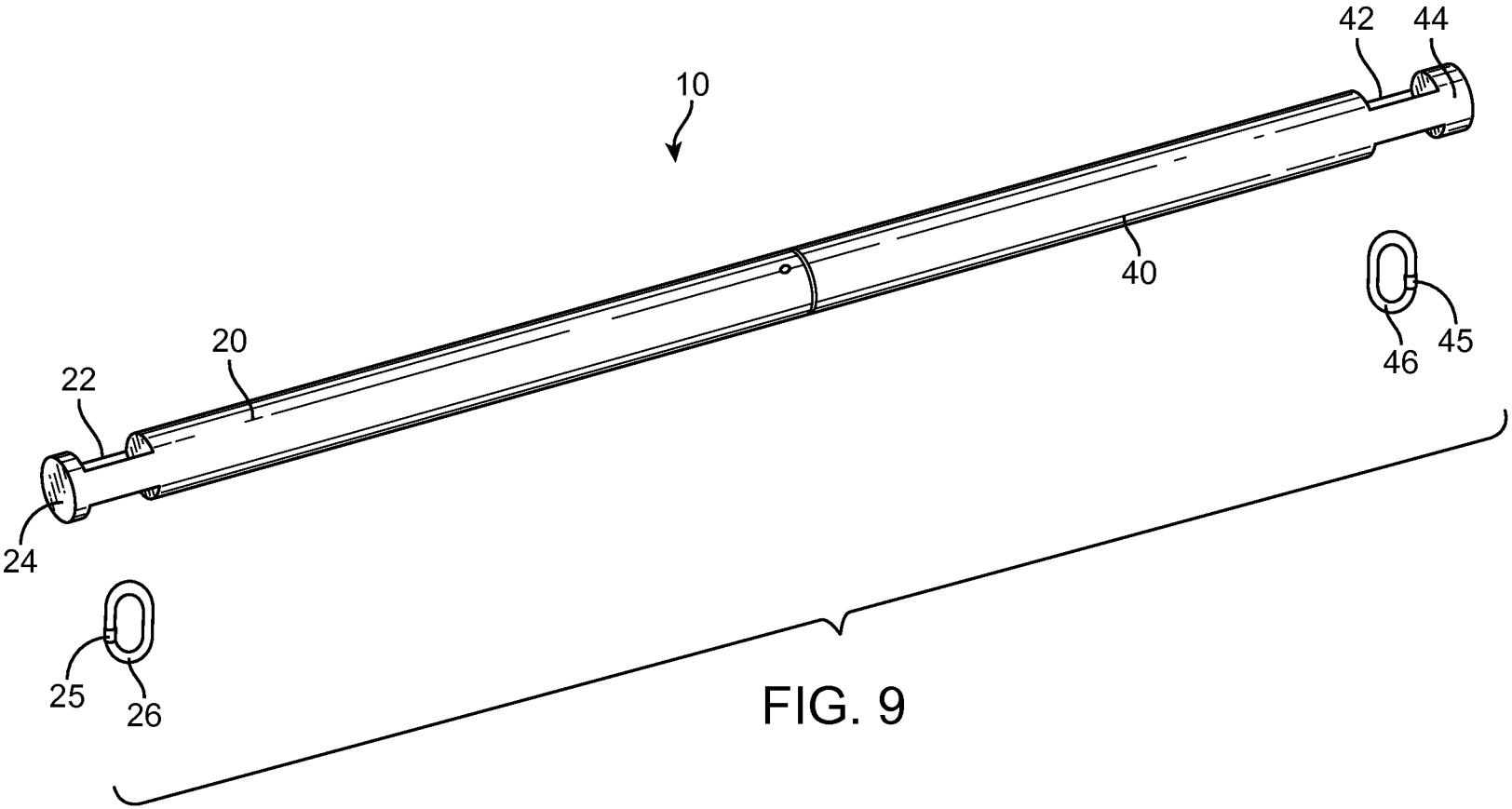
FIG. 9 is a front perspective view of the exercise resistance device without the pair of hand grips.

FIGS. 7-9 provide a close-up view of the first closed end 24 and the second closed end 44. As shown from the top view in FIG. 7, a first loop connector 27 is disposed in the first loop slot 22 and a second loop connector 47 is disposed in the second loop slot 42. In the preferred embodiment, the first loop connector 27 and the second loop connector 47 comprise metal O-rings, and they are affixed to the first elongated bar 20 and the second elongated bar 40. The first loop connector 27 connects one end of the resistive band 30 to the first elongated bar 20 via the first loop 26, and the second loop connector 47 connects the other end of the resistive band 30 to the second elongated bar 40 via the second loop 46. The first loop 26 can be opened or closed by engaging and disengaging a first stem cap 25. Similarly, the second loop 46 can be opened or closed by engaging and disengaging a second stem cap 45. In one embodiment, the first stem cap 25 and the second stem cap 45 may comprise a Snap-On mechanism. In yet another embodiment, the first stem cap 25 and the second stem cap 45 may be threaded in the internal portion. This configuration allows a user to easily change the resistive band 30 and increase or decrease the resistive band's tension according to a particular training need. In the preferred embodiment, the resistive band 30 may further comprise a set of resistive bands with various tensions and lengths that can be used together or separately. Further the resistive band 30 may be made of rubber or any suitable elastomers.

Figure 10:
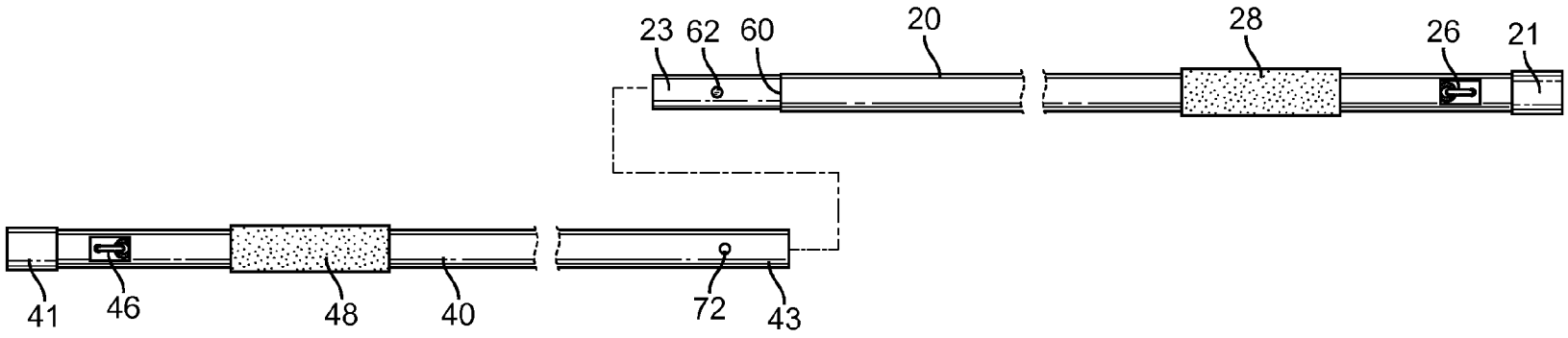
FIG. 10 is a front view of the exercise resistance device in a disassembled form.
Figure 11:
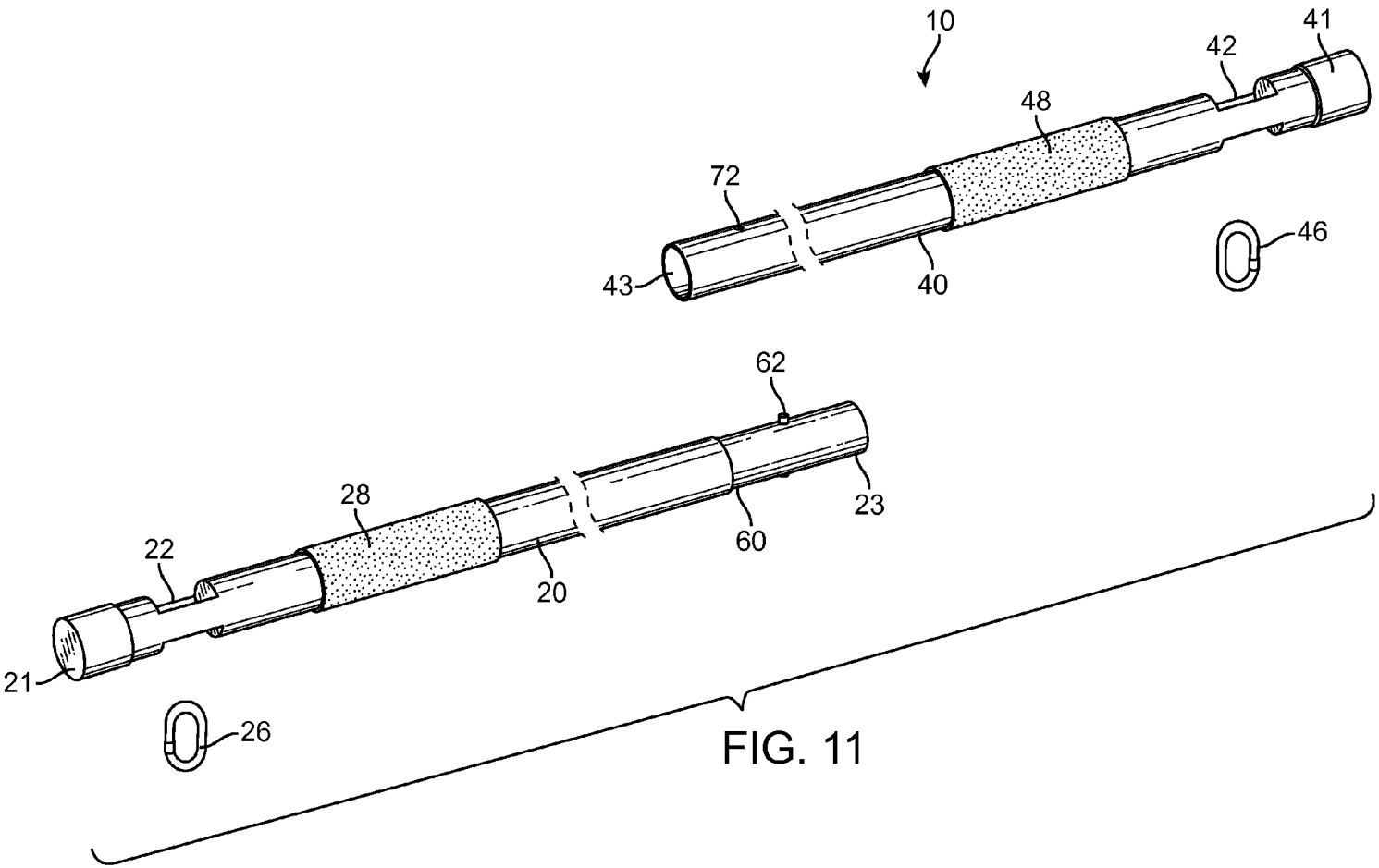
FIG. 11 is a front perspective view of the exercise resistance device in the disassembled form.

FIGS. 10-11 illustrate the resistance device 10 when it is disassembled. As previously mentioned above and shown in FIGS. 10-11, the first elongated bar 20 further comprises the male connector end 23 that securely fits into the female connector end 43 of the second elongated bar 40. This allows the resistance device 10 to be easily disassembled into two separate shorter pieces when not in use, which provides convenience for storage and traveling. When assembled, however, the connection between the male connector end 23 and the female connector end 43 is secured by the locking mechanism 62. As shown in FIGS. 10-11, the locking mechanism 62 preferably comprises a pair of spring locks 62 on the male connector end 23 that fit into the pinholes 72 on the female connector end 43. Upon inserting the male connector end 23 into the female connector end 43 to the center point 60, the spring locks 62 engage and lock into the pinholes 72. To disassemble, the spring locks 62 are pressed in while the first elongated bar 20 and the second elongated bar 40 are pulled apart.

Figure 12:
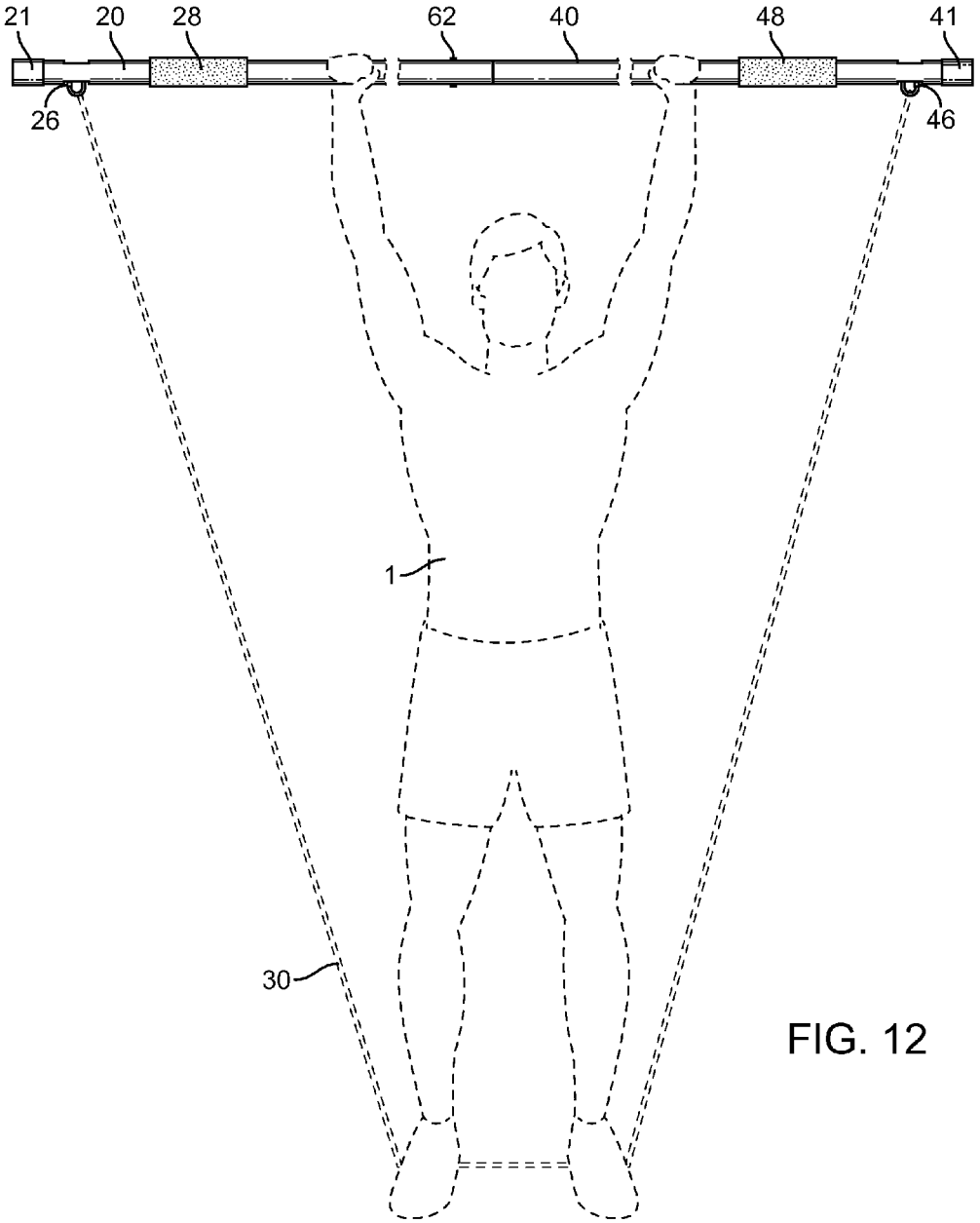
FIG. 12 is a front view of the first preferred embodiment of the exercise resistance device while in use by a user.

Having described the various components of the embodiments of the resistance device 10 in greater details, the preferred principles of operation of the resistance device 10 can be further understood by referring to the following description and FIG. 12.

FIG. 12 illustrates a front view of the resistance device 10 in its fully assembled form as it is being used by a user 1. As demonstrated here, in this particular exercise, the resistive band 30 is wrapped around both feet of the user 1 to provide resistance while the user 1 performs a repetition of pushing the resistance device 10 upward over his head. To increase or decrease the amount of resistance/tension, the user 1 may easily change the resistive band 30 with another band with the desired tension. The combination of the total length of the resistance device 10 with the slight flexibility of the carbon material provides a comfortable, yet safe and technically correct form of core training. The types of exercises that can be performed with the resistance device 10 are not limited to the exercise shown in FIG. 12. For example, the first end cap 21 and the second end cap 22 allow the resistance device 10 to be anchored to a wall attachment or other stabile objects to allow the user 1 to perform dynamic and static rotary exercises. Further, the resistance device 10 can be used in a variety of lateral plank, static and dynamic stabilization exercises.

Figure 13:
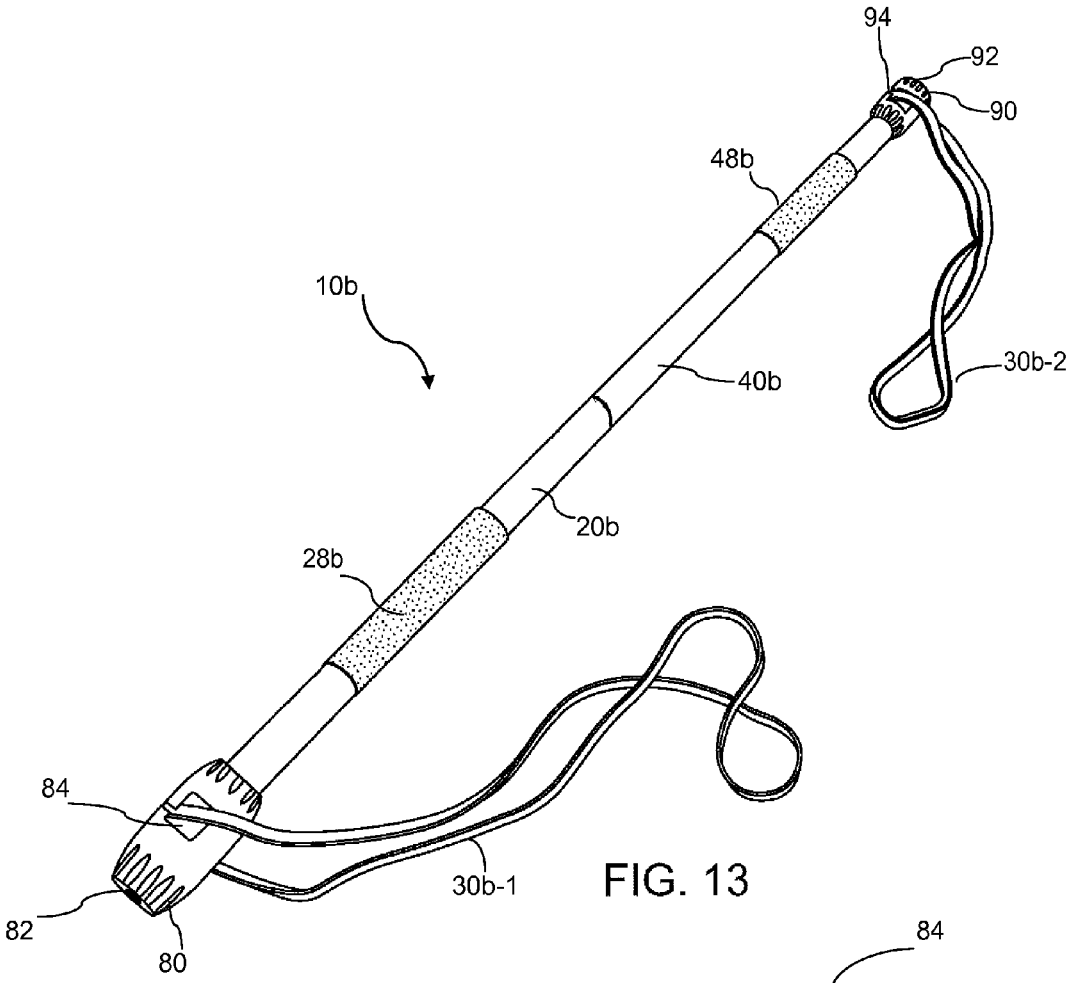
FIG. 13 is a front view of a second preferred embodiment of the exercise resistance device.
Figure 14:
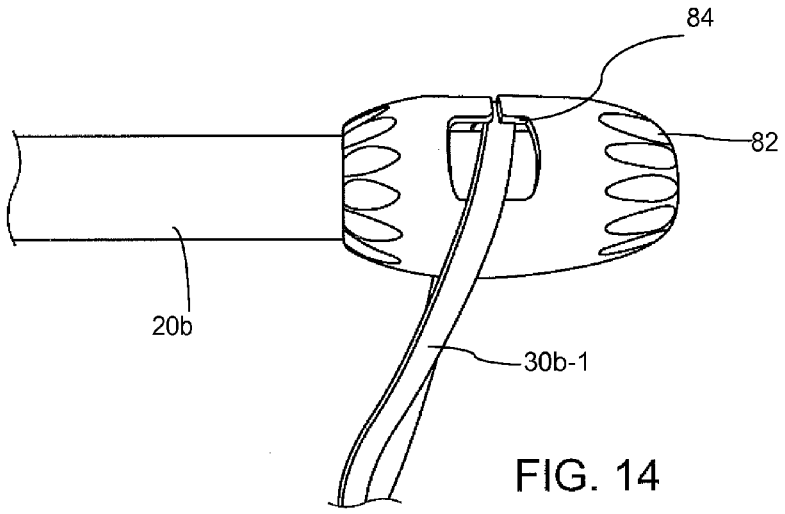
FIG. 14 is a close up view of one aspect of the second preferred embodiment of the exercise resistance device.

FIGS. 13-14 illustrate a second preferred embodiment of an exercise resistance device 10*b*, where elements of similar structure are designated by the same reference numerals followed by the lower case "b."

In this second preferred embodiment, the resistance device 10*b* comprises similar components as the resistance device 10, except that a first closed end 24*b* is covered by a first detachable loop end 80 and a second closed end 44*b* is covered by a second detachable loop end 90. The first detachable loop end 80 and the second detachable loop end 90 are identical. As shown in the figures, the first detachable loop end 80 may comprise a first plurality of ridges 82 and a first loop slit 84. Similarly, the second detachable loop end 90 may comprise a second plurality of ridges 92 and a second loop slit 94. The first detachable loop end 80 and the second detachable loop end 90 may comprise any rigid, but sufficiently flexible materials, such as rubber or plastic. This configuration obviates the need for each closed end to have a separate loop connector and a separate loop to connect the device 10*b* with a resistive band 30*b*, yet allows interchangeability of resistive bands 30*b* having various tensions.

Further, according to one embodiment, the resistance device 10*b* comprises two separate resistive bands, a first resistive band 30*b*-1 and a second resistive band 30*b*-2, that are separately connected to the first detachable loop end 80 and the second detachable loop end 90. It shall be appreciated that depending on the type of exercise to be performed, the first resistive band 30*b*-1 and the second resistive band 30*b*-2 may comprise the same tension or different tensions.

In yet other alternative embodiments, an exercise resistance device may further comprise an interchangeable first loop connector and an interchangeable second loop connector that provide various angles to connect a resistive band, and internal weights contained within a first hollow elongated bar and a second hollow elongated bar. In one preferred embodiment, the internal weights may comprise fluid.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. An exercise resistance device comprising:

a first hollow elongated bar and a second hollow elongated bar;

a first loop end piece including:

a first rigid body removably attached to the first hollow elongated bar;

a first rectangular window extending from a first side of the first rigid body through to an opposite side of the first rigid body, the first rectangular window surrounded by a first frame formed from the first rigid body, and a first fixed slit extending through the first frame of the first rectangular window, the first fixed slit generally orthogonal to a longitudinal axis of the first hollow elongated bar;

a second loop end piece including:

a second rigid body removably attached to the second hollow elongated bar;

a second rectangular window extending from a first side of the second rigid body through to an opposite side of the second rigid body, the second rectangular window surrounded by a second frame formed from the second rigid body, and a second fixed slit extending through the second frame of the second rectangular window, the second fixed slit generally orthogonal to the longitudinal axis of the second hollow elongated bar; and a first flat resistive band configured to pass from an exterior of the first frame, through the first fixed slit to extend through an interior of the first rectangular window of the first loop end piece, and a second flat resistive band configured to pass from an exterior of the second frame through the second fixed slit to extend through an interior of the second rectangular window of the second loop end piece.

2. The exercise resistance device of claim 1, wherein the first hollow elongated bar and the second hollow elongated bar further comprise carbon fiber.

3. The exercise resistance device of claim 1, wherein the first hollow elongated bar and the second hollow elongated bar further comprise aluminum.

4. The exercise resistance device of claim 1, wherein the first hollow elongated bar and the second hollow elongated bar further comprise a first loop connector and a second loop connector.

5. The exercise resistance device of claim 1 further comprises a locking mechanism to secure the first hollow elongated bar and the second hollow elongated bar.

6. The exercise resistance device of claim 1 comprising at least 6 feet in total length.

7. An exercise resistance device comprising:

a first hollow elongated bar having a first end and a second end;

a second hollow elongated bar having a first end and a second end, wherein the second end of the first hollow elongated bar is detachably connected to the second end of the second hollow elongated bar;

a first rectangular loop frame removably attached to the first hollow elongated bar, including a first fixed slit through a first side of the first rectangular loop frame, the first fixed slit generally orthogonal to a longitudinal axis of the first elongated bar;

a second rectangular loop frame removably attached to the second hollow elongated bar, including a second fixed slit through a first side of the second rectangular loop frame, the second fixed slit generally orthogonal to a longitudinal axis of the second elongated bar; and a first flat resistive band configured to pass from an exterior of the first rectangular loop frame through the first fixed slit to extend to an interior of the first rectangular loop frame, and a second flat resistive band configured to pass from an exterior of the second rectangular loop frame through the second fixed slit to extend to an interior of the second rectangular loop frame.

8. The exercise resistance device of claim 7, wherein the first hollow elongated bar and the second hollow elongated bar further comprise carbon fiber.

9. The exercise resistance device of claim 7, wherein the first hollow elongated bar and the second hollow elongated bar further comprise aluminum.

10. The exercise resistance device of claim 7, wherein the first hollow elongated bar and the second hollow elongated bar further comprise a first loop connector and a second loop connector.

11. The exercise resistance device of claim 7 further comprises a locking mechanism to secure the first hollow elongated bar and the second hollow elongated bar.

12. The exercise resistance device of claim 7 comprising at least 6 feet in total length.

* * * * *